US005497964A

United States Patent [19]

Hagiwara

[11] Patent Number: 5,497,964

[45] Date of Patent: Mar. 12, 1996

[54] STAND FOR GOLF BAG

[75] Inventor: Sanjiro Hagiwara, Tokyo, Japan

[73] Assignee: Velbon International Corporation, Torrance, Calif.

[21] Appl. No.: 213,169

[22] Filed: Mar. 15, 1994

[51] Int. Cl.[6] ..... A63B 55/00

[52] U.S. Cl. ..... 248/96; 248/688; 206/315.7

[58] Field of Search ..... 248/96, 351, 688, 248/683; 206/315.7, 315.3

[56] References Cited

U.S. PATENT DOCUMENTS

| | | | |
|---|---|---|---|
| 1,181,007 | 4/1916 | Henneberg | 248/96 |
| 1,410,989 | 3/1922 | Borthwick | 248/96 |
| 1,678,922 | 7/1928 | Singer | 248/96 |
| 1,738,242 | 12/1929 | Gunther | 248/96 |
| 1,744,557 | 1/1930 | Kuntz | 248/96 |
| 1,790,092 | 1/1931 | Duguid et al. . | |
| 1,890,964 | 12/1932 | Zahorik | 248/96 |
| 1,916,612 | 7/1933 | Galt . | |
| 1,954,413 | 4/1934 | Hunter | 248/96 |
| 1,970,849 | 8/1934 | Gunther . | |
| 2,119,695 | 6/1938 | Woodcock . | |
| 2,151,784 | 3/1939 | Love . | |
| 2,749,069 | 6/1956 | Sandstrom | 248/96 |
| 4,778,136 | 10/1988 | Reimers . | |
| 4,798,357 | 1/1989 | Cho . | |
| 4,898,352 | 2/1990 | Hoffman . | |
| 4,949,844 | 8/1990 | Yang . | |
| 5,082,218 | 1/1992 | Hoffman . | |
| 5,096,148 | 3/1992 | Quellais et al. . | |
| 5,154,377 | 10/1992 | Suk . | |

FOREIGN PATENT DOCUMENTS

| | | | |
|---|---|---|---|
| 105469 | 10/1938 | United Kingdom | 248/96 |
| 677333 | 8/1952 | United Kingdom | 248/96 |

*Primary Examiner*—Karen J. Chotkowski
*Attorney, Agent, or Firm*—Beehler & Pavitt

[57] ABSTRACT

A deployable stand has two legs pivoted to a mounting block attached to the exterior of a golf bag. The legs pivot on axes tangential to the bag circumference between a retracted mutually parallel condition and a mutually divergent deployed condition. Each leg has an extension rising above the pivot point. A hand grip is supported between the upper ends of the extensions and contains a pair of coil springs which urge the extensions apart, consequently biasing the legs towards the retracted condition. The legs are easily deployed for setting down the bag simply be squeezing the grip against the rim of the bag with one hand. The stand can be supported to the bag by a strap or can be a permanent part of the bag.

25 Claims, 4 Drawing Sheets

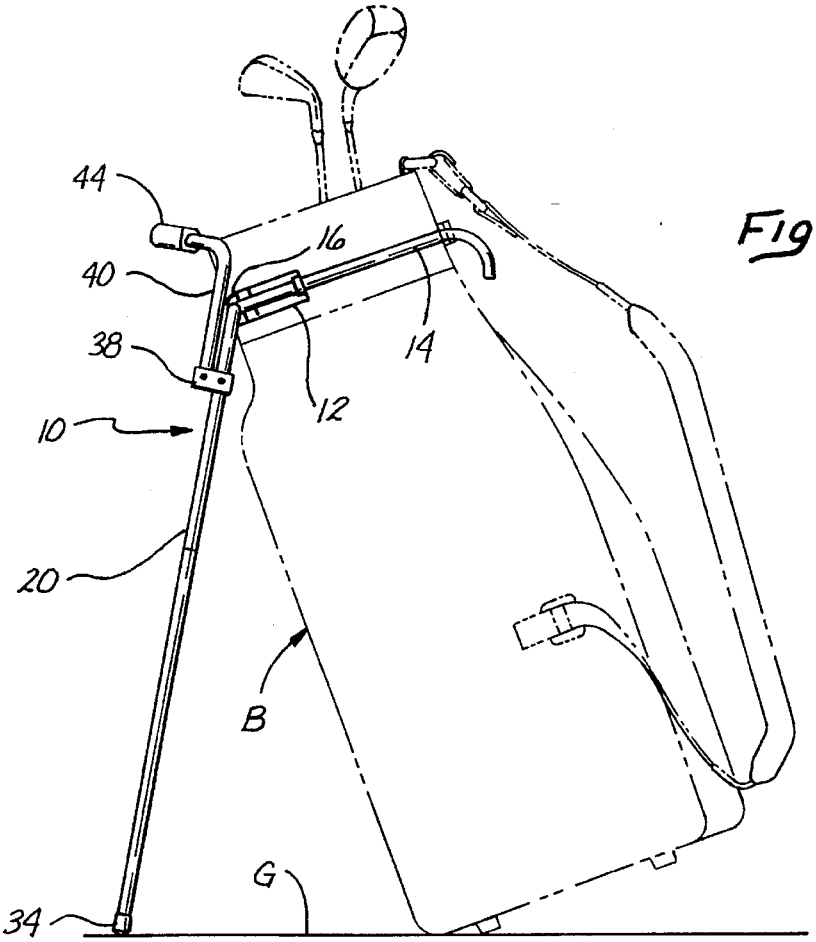
Fig. 4
Fig. 8
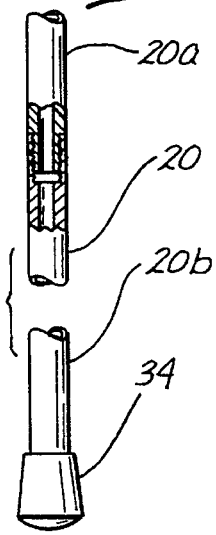
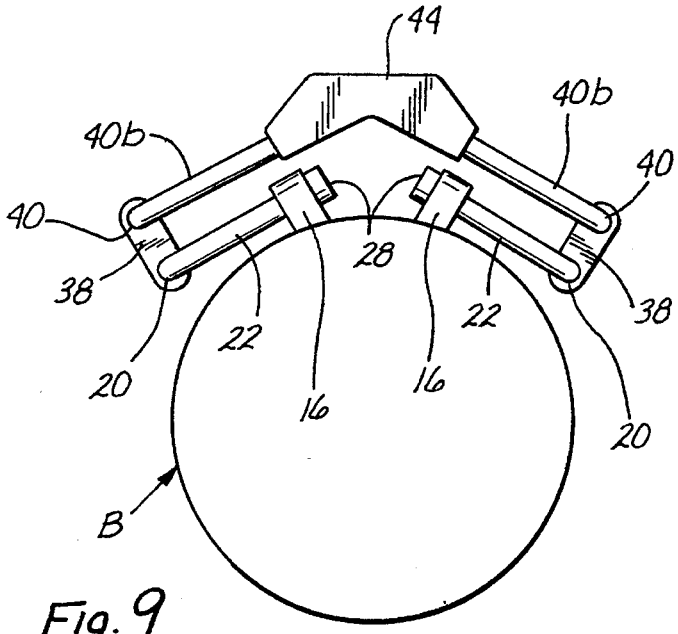
Fig. 9

STAND FOR GOLF BAG

BACKGROUND OF THE INVENTION

1. Field of the Invention

This invention relates to stands for golf bags useful for supporting the golf bag upright when the bag is set down on a ground surface.

2. State of the Prior Art

Golf bag stands of this general type are disclosed in U.S. Pat. Nos. 2,151,784 and 2,119,695. The golf bag stand described in U.S. Pat. No. 2,151,784 has a pair of legs bent horizontally at their top ends to form shaft sections, which are free to turn within shaft supports, and the legs are springloaded to a folded condition against the side of the golf bag to which the shaft supports are mounted. A handle for deploying the legs away from the golf bag is attached to one of the legs. Likewise, the stand described in U.S. Pat. No. 2,119,695 has a pair of freely movable legs mounted to a golf bag and springloaded to a retracted position against a golf bag, with a handle attached to a leg for deploying the stand.

Conventional golf bag stands, such as those disclosed in the aforementioned patents, are difficult to assemble because the springs are wound onto the legs of the stand, and the exposed springs can catch the clothing of the user, among other hazards.

What is needed is a stand which addresses the aforementioned problems and has legs normally held close against the golf bag when not in use, and in which the legs can be deployed for supporting the golf bag in a stable position when needed for holding the bag upright. Also desirable is easy assembly of the springs to the stand for holding the legs against the golf bag, and avoiding exposed springs to make the stand safer.

SUMMARY OF THE INVENTION

This invention addresses the aforementioned needs by providing a stand for a golf bag which has a carrier band attachable to the exterior of a golf bag, a pair of legs, each leg having an upper end pivoted to the carrier band about corresponding first and second pivot axes angled to one another. The legs are extended upwardly by an actuating rod attached to each of the legs and extending above the pivoted upper ends of the legs. Due to the angle between the leg pivot axes, the legs are generally parallel to each other in their retracted position against the golf bag and are spread apart at their lower ends in the deployed position. The actuating rods swing about the leg pivot axes in a direction opposite to that of the legs. As a result of the angles pivot axes, the upper ends of the actuating rods are closer to each other in the extended position of the legs than in the retracted position. A spring arrangement normally urges the actuating rods apart thereby continuously biasing the legs to a retracted position, the legs being deployable by urging the upper ends of the actuating rods towards the carrier band and thus towards the golf bag. A hand grip may be supported between the upper ends of the actuating rods for use in urging the actuating rods towards the carrier. The springs are preferably coil springs entirely contained within bores defined in the hand grip. The upper ends of the actuating rods may be bent and slidingly inserted into the hand grip bores for compressing the coil springs. This arrangement greatly simplifies the assembly of the springs which need only be inserted into the hand grip bores without special mounting or engagement to the stand legs. Furthermore, the spring are not exposed for protection of the user.

The carrier band may be semicircular so that the first and second pivot axes are tangential to the band at circumferentially spaced locations thereof. More particularly, the legs may be pivoted to shaft bearings on an outer convex surface of the carrier band. The hand grip may have opposed blind bores angled to define third and fourth pivot axes parallel to the first and second pivot axes respectively, and the bent upper ends of the actuating rods may have inner ends slidingly inserted in the bores and compressing the springs contained in the bores. Each of the legs may be a length of tubing bent at an upper end to form a leg shaft section, the leg shaft section being pivoted in a corresponding shaft bearing mounted on the carrier band. Each actuating rod may be a length of tubing bent to form a vertical section fixed at a lower end thereof to one of the legs and an actuating shaft section terminating in an inner end of the actuating rod. A stop element such as an end cap may be threaded on the leg shaft section for preventing withdrawal of the leg shaft section from its shaft bearing for holding together the stand. The stand can be a permanent part of a golf bag by permanently mounting the shaft bearings directly to the golf bag rather than to a detachable carrier band.

Operation of the golf bag stand for deploying the stand legs from their normal retracted or folded condition against the bag to a deployed, bag-supporting position simply entails pushing the hand grip toward the golf bag, so that force is applied against the actuating rods. This can be a one handed operation. Because the legs in their deployed condition are spread apart at their lower ends, the upper ends of the actuating rods tend to come closer to each other and the inner ends of the shaft sections of the actuating rods advance into the opposed bores in the hand grip and against the springs contained in the bores, thereby compressing the springs. The stand remains in this condition as long as the bag is supported on a ground surface by the deployed legs. When the golf bag is picked up, as soon as the lower ends of the stand legs are lifted away from contact with the ground surface, the force of the compressed springs acting upon the inner ends of the shaft sections of the actuating rods urges apart the upper ends of the actuating rods, and the spring force is transferred by the actuating rods to the stand legs so as to pivot the legs to a folded condition where the stand legs are retracted closely against the golf bag and held in the retracted position by the spring force.

BRIEF DESCRIPTION OF THE DRAWINGS

FIG. 4 shows the stand in deployed position for supporting the phantom-lined golf bag upright on a ground surface;

FIG. 8 shows a stand leg partly in section to illustrate the threaded joint between sections of the stand leg.

FIG. 9 is a top plan view as in FIG. 5 showing the leg bearings attached directly to the golf bag for permanent installation of the retractable stand.

DETAILED DESCRIPTION OF THE PREFERRED EMBODIMENT

Figure 1:
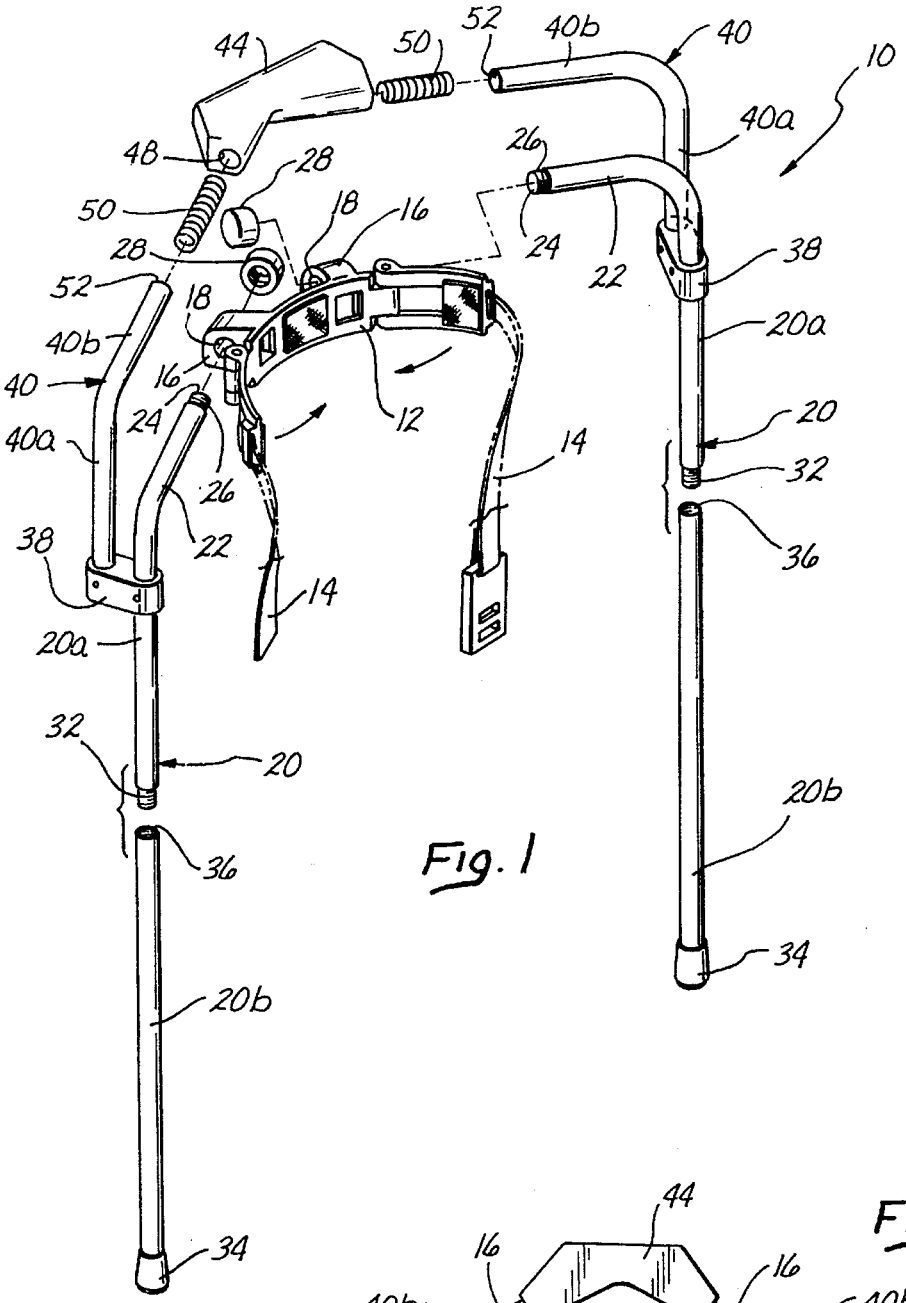
FIG. 1 is a perspective view of a golf stand according to this invention.
Figure 5:
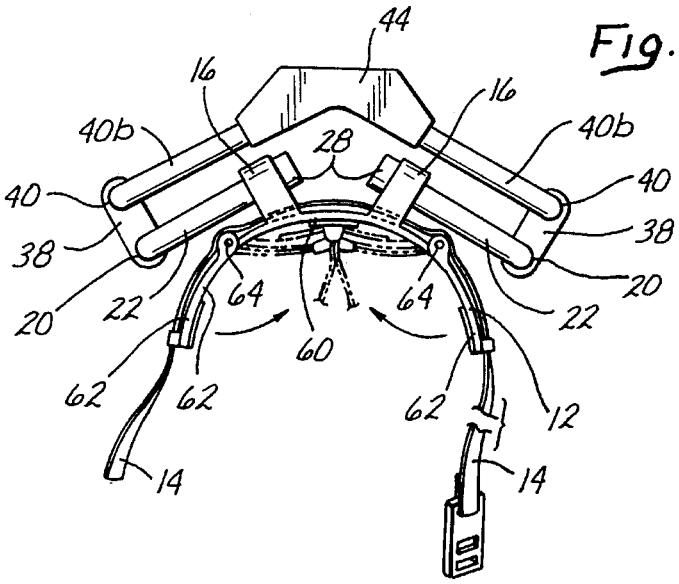
FIG. 5 is a top plan view of the stand.

With reference to the accompanying drawings, FIG. 1 shows a golf bag stand, generally designated by the numeral 10, which has a semicircular carrier band 12 equipped with a belt 14 for attaching the carrier band to the upper part of a golf bag. Two shaft bearings 16 are spaced along the outer, convex side of the carrier band. The shaft bores 18 open away from each other at one end, and at an opposite end open towards each other and the center of the carrier band. Each shaft bore 18 defines a leg pivot axis which is tangential to the carrier band and lie in a common plane. The pivot axes defined by the two bearings 16 are therefore angled to each other as best seen in FIG. 5. The carrier band may be assembled of three sections, a middle section 60 carrying the shaft bearings 16 and two sections 62 hinged at 64 to either side of the middle section for folding as suggested by the arrows in FIGS. 1 and 5 to a compact configuration phantom lined in FIG. 5.

Figure 7:
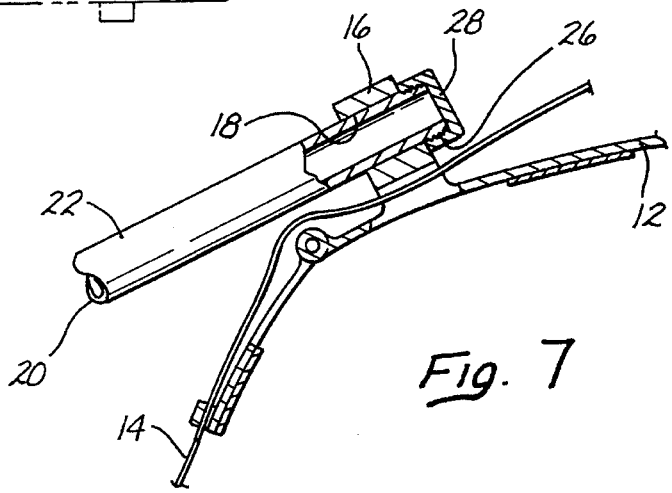
FIG. 7 is a detail view partly in section showing the pivotal attachment of a stand leg in a shaft bearing of the carrier band.

A pair of stand legs 20 are each bent at their upper ends to form shaft sections 22, each of which is held in a sliding rotatable fit in the shaft bore 18 of a corresponding bearing 16. As shown in FIGS. 1 and 7, the inner end 24 of each shaft section 22 has a thread 26, onto which is threaded an end cap 28 of enlarged outer diameter which prevents withdrawal of the shaft section 22 from the bearing 16. Each leg 20 is made up of two leg sections; a top leg section **20*a* which is bent to form the shaft section 22 at its upper end and which has a threaded section 32 at its lower end, and a lower leg section 20*b* which is fitted with a tip 34 at its lower end and an internal thread 36 which mates with the thread 32, to make up the stand leg 20**.

Figure 2:
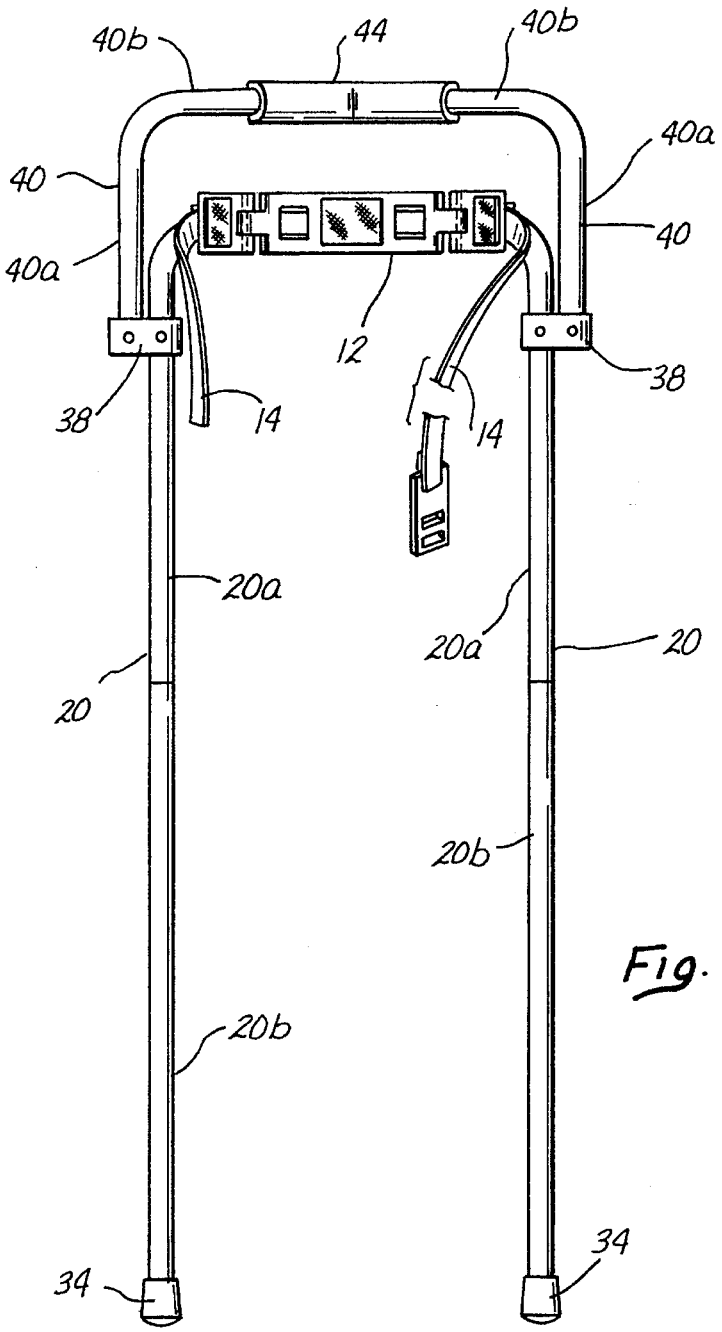
FIG. 2 is a front elevational view of the stand.

The stand 10 also has a pair of actuating rods 40 which have lower ends fixedly attached to the legs 20 by means of fasteners 38 at a point below the bent upper end of each leg 20. Each actuating rod has a vertical section **40*a* which rises above the leg shaft sections 22 and bearings 16 of the carrier band 12, i.e. above the pivot point of the legs 20, and a horizontal shaft section 40*b* which is at a right angle to the vertical section 40*a* as shown in FIG. 2**.

Figure 6:
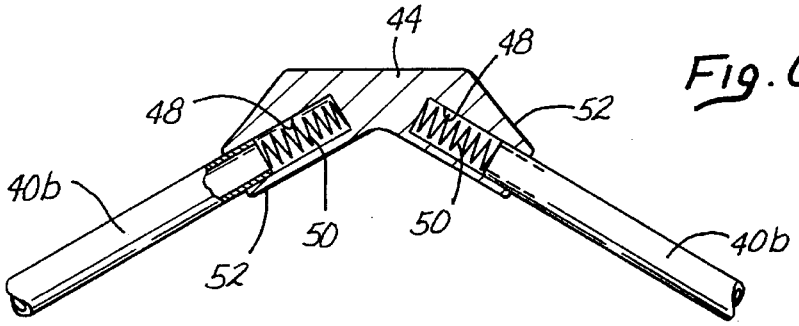
FIG. 6 is a horizontal section of the hand grip showing the arrangement of the springs in the hand grip bores.

A hand grip 44 is supported between and connects the horizontal shaft sections **40*b* of the actuating rods 40. The grip 44 has opposed blind bores 48 which are angled towards each other at an angle similar to that between the pivot axes defined by the shaft bores 18, as best understood by reference to FIG. 5. The actuating rod shaft sections 40*b* are inserted in a sliding fit into the corresponding bores 48 of the hand grip, allowing the shaft sections to both rotate as well as slide back and forth axially within the bores of the hand grip. A coil spring 50 is inserted into each blind bore 48 of the hand grip and is contained between the bottom of the blind bore and the inner end 52 of the shaft section 40*b* of the corresponding actuating rod, as shown in FIG. 6**.

Figure 3:
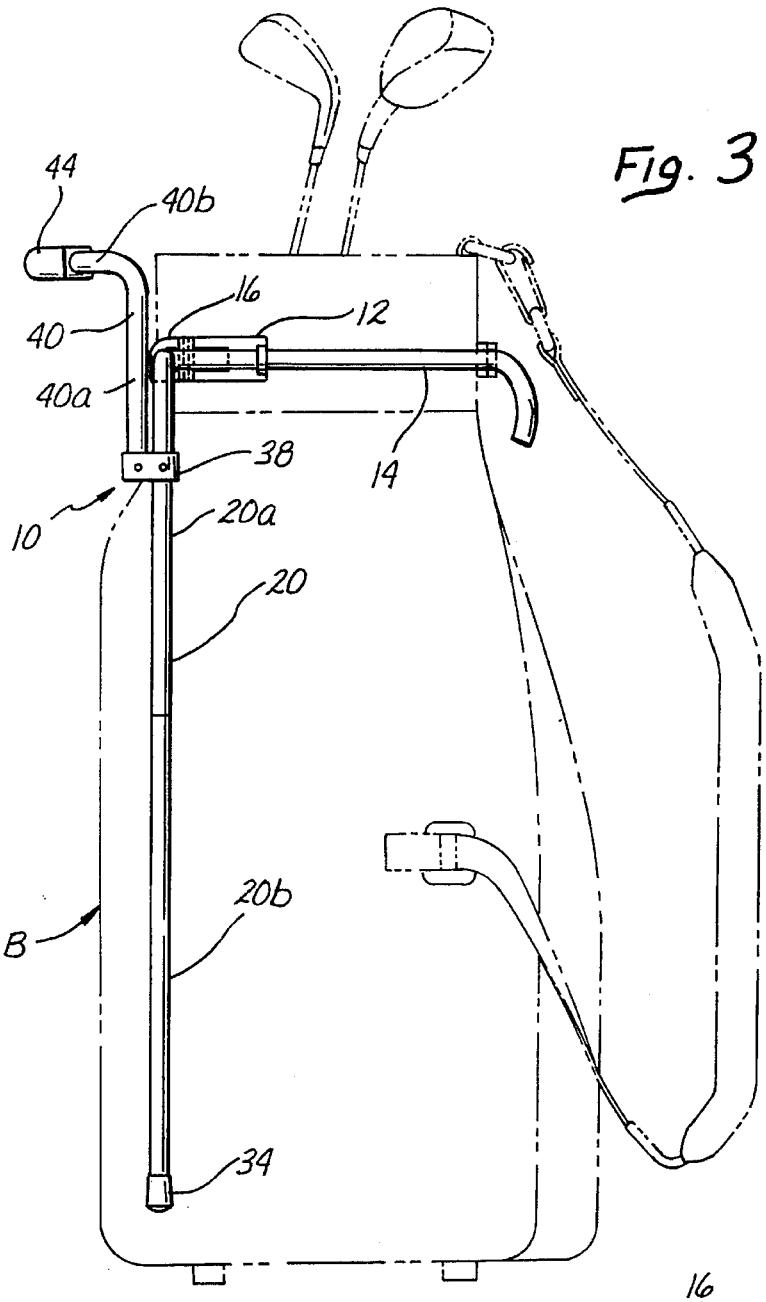
FIG. 3 is a side elevational view of the stand in its retracted position on a typical golf bag, the bag being shown in phantom lining.

The operation of the preferred embodiment in actual use will now be described. FIG. 3 shows the stand 10 attached to a typical golf bag B shown in phantom lining. The concave inner side of the carrier band 12 is fitted against the top portion the bag B and secured in place by buckling the ends of the belt 14. The stand legs 20 are shown in their normal retracted position, extending along and against the outer surface of the bag B. The legs 20 are extended to a deployed position illustrated in FIG. 4 by manually pushing the hand grip 44 toward the golf bag B. This can be accomplished by squeezing with one hand, for example with the thumb hooked over the rim of the golf bag and the forefingers of the hand curled over the hand grip. As the hand grip 44 moves towards the golf bag B, it carries the upper ends of actuating rods 40 which in turn transmit this force to the stand legs 20. In effect, the actuating rods 40 pivot together with the legs 20 but on opposite sides of the divergent leg pivot axes defined by the shaft bores 18 of bearings 16. Movement of the hand grip 44 towards the golf bag B consequently results in opposite pivotal movement of the legs 20 away from the golf bag B. Furthermore, due to the angled relationship of the leg pivot axes defined by shaft bores 18, the stand legs 20 spread apart at their lower ends as the legs swing away from the golf bag B.

The golf bag can be supported in an upright but somewhat inclined position, such as shown in FIG. 4, as long as the lower ends of the stand legs 20 are restrained in the deployed position by weight bearing contact with a ground surface G. In this condition, while the lower ends of the stand legs 20 are deployed away from the golf bag B, the upper ends of the actuating rods 40 come closer to each other due to the divergence in the leg pivot axes defined by the bearings 16. Consequently, the inner ends 52 of the actuating rod shaft sections **40*b* advance towards each other and into the blind bores 48 of the hand grip 44, compressing the coil springs 50** against the bottom of the corresponding bores.

As soon as the golf bag B is lifted by the user so that the lower ends of the stand legs 20 are raised away from contact with the ground surface G, the legs are freed to respond to the force of springs 50 acting upon the actuating rods 40 and tending to spread them apart at their upper ends. As a result the legs 20 pivot about the divergent axes defined by the shaft bearings 16 towards and against the golf bag G, and under continuous urging of the springs 50 remain in the retracted position of FIG. 3 until the legs 20 are again deployed by manual operation of the hand grip 44, as earlier described.

It will be appreciated that assembly of the stand 10 is quite straightforward. The pivot shaft sections 22 of the stand legs 20 are inserted into bores 18 of the bearings 16, the coil springs 50 and the actuating rod pivot shaft sections **40*b* are inserted into the bores 48 of the hand grip 44, and the entire stand assembly is held together by threading the end caps 28 upon the end threads 26 of the stand legs. It should be particularly appreciated that, unlike previously devised golf bag stands, the need to lock the springs to the stand legs or other components of the stand has been completely eliminated, and the springs 50 are installed by simply inserting the springs into the bores 48 of the hand grip. Furthermore, the springs 50 are fully enclosed in the hand grip 44 so that no portion of the springs is exposed. Consequently, the outer clothing of a golfer carrying the bag B fitted with the stand 10** is safe from entanglement and possible tearing by exposed springs, and the golfer is protected against injury due to possible pinching of the skin between coils of the springs as they expand and compress during deployment and retraction of the stand.

While the stand 10 has been described as an attachment for a golf bag B where the shaft bearings 16 are on a carrier band 12 attachable to the golf bag, it will be understood that the stand can be a permanent part of the golf bag B by mounting the bearings 16 or equivalent elements directly and permanently to the golf bag B, as illustrated in FIG. 9.

From the foregoing it will be apparent that this invention provides a golf stand with legs which are spring loaded towards a retracted position in which the spring loading keeps the legs securely against the golf bag so that the legs do not obstruct or interfere with carrying of the bag, while providing good stable support for the bag on a ground surface when the bag is set down. Deployment of the stand can be conveniently accomplished with one hand and retraction of the legs occurs under spring loading as soon as the bag is lifted from the ground surface for carrying. The stand of this invention is particularly easy and simple to assemble with no need to make any special interlocking installation of the springs with any part of the mechanism, but rather, by simply inserting the springs into corresponding openings in the hand grip of the stand, where the springs are fully enclosed and the user is shielded against snagging and pinching by the springs.

Furthermore, the stand of this invention is readily attachable to a golf bag of the type which has a pocket-type storage section incorporated onto the exterior of the bag.

While certain preferred embodiments of the invention have been described and illustrated for purposes of clarity and example, it must be understood that many changes, substitutions, and modifications to the described embodiments will become obvious to those possessed of ordinary skill in the art without their thereby departing from the scope and spirit of the present invention which is defined by the following claims.

What is claimed is:

1. A stand for a golf bag comprising:

bearing means:

a pair of legs extending below said bearing means and having an upper end pivoted to said bearing means about corresponding first and second leg pivot axes, said leg pivot axes being angled to one another;

actuating rod means attached to each of said legs, said actuating rod means extending above said bearing means;

spring means compressed between upper ends of said actuating rod means for continuously biasing said legs to a retracted position, said legs being deployable in one direction about said pivot axes by manually pivoting said actuating rod means in an opposite direction against the bias of said spring means; and a hand grip supported between said upper ends of said actuating rod means for use in pivoting said actuating rod means.

2. The stand of claim 1 wherein said spring means are contained in said grip.

3. The stand of claim 2 wherein said grip has bores and said spring means comprise coil spring means contained in said bores.

4. The stand of claim 3 wherein said actuating rod means have inner ends inserted in said bores against said spring means.

5. The stand of claim 4 wherein said inner ends make a sliding fit in said bores.

6. The stand of claim 1 wherein said bearing means are on a semicircular carrier band attachable to a golf bag and said first and second leg pivot axes are tangential to said band at circumferentially spaced locations thereof.

7. The stand of claim 6 wherein said legs are pivoted to shaft bearings on an outer convex surface of said band.

8. The stand of claim 1 wherein said grip has opposed blind bores angled to each other along third and fourth axes parallel to the first and second axes respectively.

9. A stand for attachment to a golf bag, comprising:

a carrier band;

means for attaching said carrier band to the exterior of a golf bag;

a pair of legs, each leg having an upper end pivoted to said carrier band about corresponding first and second pivot axes, said pivot axes being angled to one another;

an actuating rod rigidly attached to each of said legs and having inner ends above said upper ends;

grip means, openings in said grip means, said inner ends slidingly inserted into said openings, and spring means contained in said openings normally urging said inner ends apart thereby continuously biasing said legs to a retracted position, said legs being deployable in one direction by moving said grip and the actuating rods in an opposite direction about said pivot axes.

10. The stand of claim 9 wherein said carrier band is circularly arcuate, and said first and second pivot axes are tangential to said band at circumferentially spaced locations thereof.

11. The stand of claim 9 wherein said openings are opposed blind bores angled to each other along third and fourth axes parallel to said first and second axes respectively.

12. The stand of claim 9 wherein each said actuating rod is bent to form a vertical section fixed at a lower end thereof to one of said legs and an actuating shaft section terminating in one of said inner ends.

13. The stand of claim 9 wherein said legs each comprise a length of tubing bent at an upper end to form a leg shaft section, each said leg shaft section being pivoted in a corresponding shaft bearing on said carrier band.

14. The stand of claim 13 further comprising stop means on said leg shaft section for preventing withdrawal of said leg shaft section from said corresponding shaft bearing.

15. The stand of claim 14 wherein said stop means is threaded onto an end of said leg shaft section.

16. A stand for attachment to a golf bag, comprising:

a carrier band;

means for attaching said carrier band to the exterior of a golf bag;

a pair of legs, bent at an upper end to form a leg shaft section, each said leg shaft section being pivoted in a corresponding shaft bearing on said carrier band, said shaft bearings being angled to one another;

a pair of actuating rods each bent to form a vertical section fixed to one of said legs and an actuating shaft section terminating in an inner end above said upper ends; and spring means compressed between said inner ends continuously biasing said legs to a retracted position, said legs being deployable by urging said inner ends towards said carrier band.

17. The stand of claim 16 further comprising grip means, openings in said grip means, said inner ends slidingly inserted into said openings, said spring means contained in said openings and compressed between said inner ends.

18. The stand of claim 16 wherein said legs are generally parallel to each other in said retracted position and spread apart in said deployed position.

19. A stand for attachment to a golf bag, comprising:

bearing means;

a pair of legs extending below said bearing means, each bent at an upper end to form a leg shaft section, each said leg shaft section being pivoted to said bearing means along first and second pivot axes angled to each other;

a pair of actuating rods each bent to form a vertical section fixed to one of said legs and an actuating shaft section terminating in an inner end above said bearing means;

a hand grip, opposed blind bores in said grip, said inner ends slidingly inserted into said bores for pivotal movement about third and fourth pivot axes parallel to said first and second pivot axes respectively; and coil springs contained in said bores for urging apart said inner ends thereby continuously biasing said legs to a retracted generally parallel position, said legs being deployable in one direction about said bearing means to a spread apart position by actuating said grip in an opposite direction about said bearing means.

20. The stand of claim 19 wherein said bearing means are on an arcuate carrier band attachable to a golf bag and said first and second pivot axes are tangential to said band at circumferentially spaced locations thereof.

21. The stand of claim 19 wherein said bearing means are permanently mounted to a golf bag.

22. A stand for a golf bag, comprising:

bearing means including means for attaching said bearing means to a golf bag:

a pair of leg means each having an upper end and a lower end, said leg means being pivoted at said upper end said bearing means for movement between a generally mutually parallel retracted condition and a mutually divergent deployed condition;

grip means supported only on said leg means between and above said upper ends; and spring means compressed between said upper ends and urging said upper ends apart thereby biasing said leg means towards said retracted condition.

23. The stand of claim 22 wherein said spring means is contained in said grip means.

24. The stand of claims 22 wherein said bearing means are supported on a carrier band for use in attaching said bearing means to a golf bag.

25. The stand of claim 22 wherein said each said leg means comprises a leg extending below said bearing means and having an upper end pivoted to said bearing means about a corresponding one of first and second leg pivot axes, said leg pivot axes being angled to one another and actuating rod means attached to said leg, said actuating rod means extending above said bearing means.

* * * * *